United States Patent [19]

Sherman

[11] Patent Number: 4,998,646

[45] Date of Patent: Mar. 12, 1991

[54] FLEXIBLE POUCH CONTOURED TO FACILITATE POURING

[75] Inventor: Adam Sherman, Brooklyn, N.Y.

[73] Assignee: Colgate-Palmolive Co., Piscataway, N.J.

[21] Appl. No.: 327,844

[22] Filed: Mar. 23, 1989

[51] Int. Cl.[5] ..... B65D 35/08

[52] U.S. Cl. ..... 222/107; 222/541

[58] Field of Search ..... 222/92, 107, 490, 494, 222/541; 206/620; 383/42, 906

[56] References Cited

U.S. PATENT DOCUMENTS

| | | | |
|---|---|---|---|
| 2,093,974 | 9/1937 | Farmer | 206/620 |
| 2,446,308 | 8/1948 | Smith | 229/14 |
| 2,620,944 | 12/1952 | Stahl | 222/107 |
| 2,851,212 | 9/1958 | Parmer | 206/620 |
| 2,866,488 | 3/1956 | Thompson | 150/5 |
| 2,999,627 | 9/1961 | Reinhardt | 229/55 |
| 3,112,047 | 11/1963 | Weinrich et al. | 222/105 |
| 3,171,581 | 3/1965 | Kugler | 229/53 |
| 3,380,646 | 4/1968 | Doyen et al. | 229/57 |
| 3,437,258 | 8/1969 | Kugler | 229/58 |
| 3,463,357 | 8/1969 | MacLean, Jr. et al. | 222/94 |
| 3,473,703 | 10/1969 | Lippincott | 222/215 |
| 3,815,974 | 6/1974 | Carlisle | 222/491 |
| 3,907,164 | 9/1975 | Stich | 222/3 |
| 3,935,993 | 2/1976 | Doyen et al. | 229/53 |
| 4,015,635 | 4/1977 | Goransson | 138/119 |
| 4,119,128 | 10/1978 | Bishop | 150/8 |
| 4,285,376 | 8/1981 | Ausnit | 150/3 |
| 4,353,497 | 10/1982 | Bustin | 229/55 |
| 4,454,979 | 6/1984 | Ikeda et al. | 229/52 B |
| 4,498,591 | 2/1985 | Smith, II | 206/620 |
| 4,578,813 | 3/1986 | Ausnit | 383/65 |

FOREIGN PATENT DOCUMENTS

| | | |
|---|---|---|
| 572976 | 9/1962 | Belgium . |
| 1366310 | 6/1964 | France . |
| 1020904 | 7/1984 | France . |

*Primary Examiner*—Michael S. Huppert

*Attorney, Agent, or Firm*—Michael J. McGreal; Murray M. Grill; Robert C. Sullivan

[57] ABSTRACT

A flexible self-standing pouch made from at least one layer of plastic material bonded to form a closed inner chamber for storing liquid. Peripheral portions of the wall material are contoured and then bonded to form a closed pouring spout at a corner of the pouch. The configuration of the spout is defined by the contour of the sealing in the vicinity of that pouch corner. The pouring spout is opened by cutting the pouch corner at an angle. The bonded peripheral edge has a generally rectangular contour except for an inwardly curved portion corresponding to a recess in the wall material, which recess partly defines the spout configuration. This recess has a maximum height which is greater than the maximum depth measured in a direction transverse to the direction along which the height is measured. Further, the recess may either begin at the top of the pouch or at a point along the side which is spaced from the top. A juncture portion along the top of the pouch and a juncture portion along the rim of the recess define the configuration of the open pouring spout, which open spout is intended to be inserted in the open neck of a container to be filled.

10 Claims, 6 Drawing Sheets

FLEXIBLE POUCH CONTOURED TO FACILITATE POURING

FIELD OF THE INVENTION

This invention relates to a flexible pouch made of laminated material used for refilling other containers.

BACKGROUND OF THE INVENTION

The use of flexible pouches liquids made of laminations of plastic material to dispense liquids is well known. One such pouch is disclosed in U.S. Pat. No. RE 24,251.

A pouch made of metallic foil and having a contoured pouring spout is disclosed in U.S. Pat. No. 3,907,164. However, this conventional package has a reduced storage capacity due to the shape of the container and has no means for facilitating the pouring of liquid from the container into the neck of another container. The latter disadvantage is because when the pouch is turned to the pouring position, its pouring spout does not make use of the contoured configuration. On the contrary, the contour merely serves to define the pouring spout and not to receive the neck of another container.

SUMMARY OF THE INVENTION

The object of the invention is to overcome the foregoing disadvantages of conventional pouch for storing liquids.

More specifically, it is an object of the invention to provide a heat-sealed pouch which has a contoured configuration which facilitates the pouring of liquid from the pouch into another container.

It is a further object of the invention to provide a pouch having a spout which can be mass-produced from webs of sheet-like material with a minimum of wasted material.

The invention is a self-standing flexible pouch made from at least one layer of plastic material heat-sealed to form a closed inner chamber for storing liquid. Alternatively the pouch in accordance with the invention may have laminated walls comprising a layer of foil adhered to a layer of plastic.

A pouch in accordance with the preferred embodiments of the invention has a peripheral edge formed by fin sealing two layers of wall material together. In accordance with one preferred embodiment, two sheets of wall material are fin-sealed together along their entire peripheries. In accordance with another preferred embodiment, one portion of the peripheral edge of a folded single sheet of wall material is fin-sealed to the remaining portion of the peripheral edge of that single sheet.

A self-standing pouch in accordance with the preferred embodiments of the invention is gusseted at its bottom to enable the pouch to stand in an upright position when filled with liquid.

Peripheral portions of the wall material are contoured and then heat-sealed or adhered to form a closed pouring spout at a corner of the pouch. The configuration of the spout is defined by the contour of the heat sealing or adhesion in the vicinity of that pouch corner. The pouring spout is opened by cutting the pouch corner at an angle.

In accordance with the preferred embodiments of the invention, the juncture has a generally rectangular contour, except for an inwardly curved portion which defines at least a portion of a recess in the pouch wall.

This recess in turn defines a part of the spout configuration. The recess has a maximum height which is greater than the maximum depth measured in a direction transverse to the direction along which the height is measured. In accordance with one preferred embodiment, the recess may begin at the top of the pouch. In accordance with another preferred embodiment, the recess may begin at a point along the side which is spaced from the top.

In accordance with the preferred embodiments of the invention, a juncture portion along the top of the pouch and a juncture portion along the rim of the recess define the configuration of the open pouring spout, which open spout is intended to be inserted in the open neck of a container to be filled.

In accordance with one preferred embodiment of the invention, a second recess is formed on the opposite side of the pouch, thereby defining a second closed pouring spout.

Other objects of the invention will be apparent from the detailed description of the invention hereinafter.

BRIEF DESCRIPTION OF THE DRAWINGS

The preferred embodiments of the invention will be described in detail hereinafter with reference to the accompanying drawings, wherein.

DETAILED DESCRIPTION OF THE PREFERRED EMBODIMENTS

Figure 1:
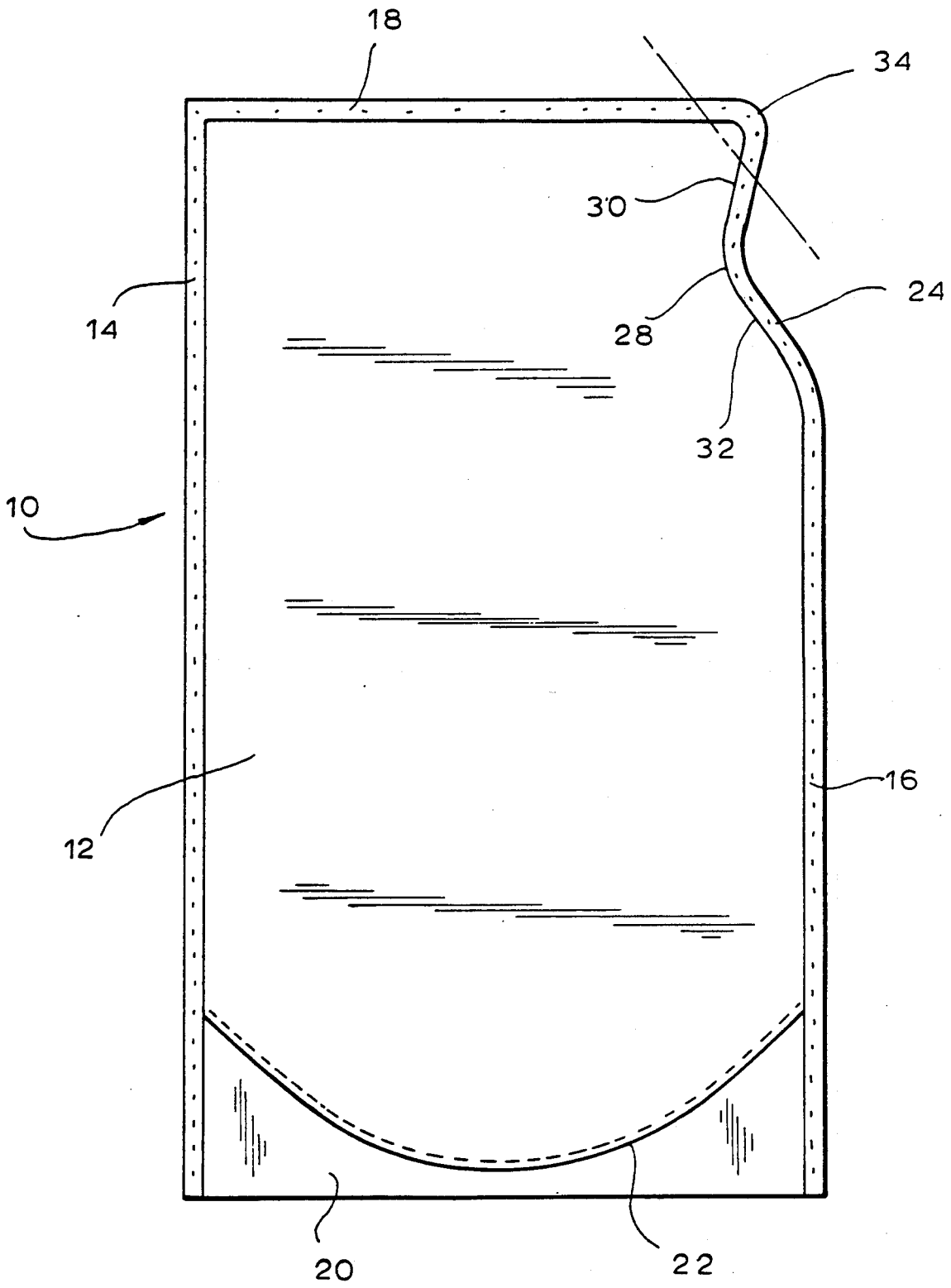
FIG. 1 is a side view of a flexible pouch with closed pouring spout in accordance with a first preferred embodiment of the invention.
Figure 2:
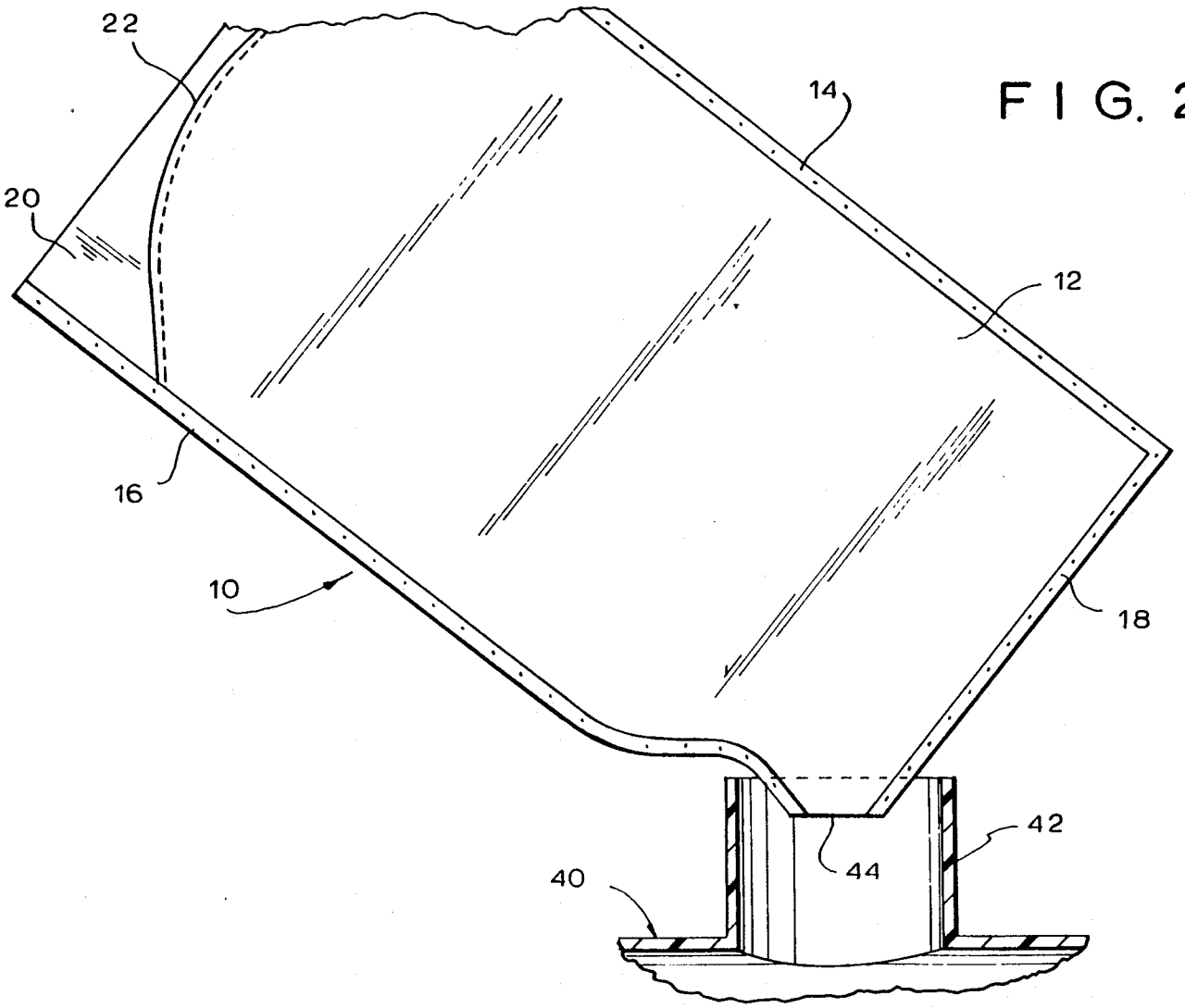
FIG. 2 is a partial side view of the flexible pouch of FIG. 1 with the spout open and a partial sectional view of the neck of a container to be filled in which the open spout has been inserted.
Figure 3:
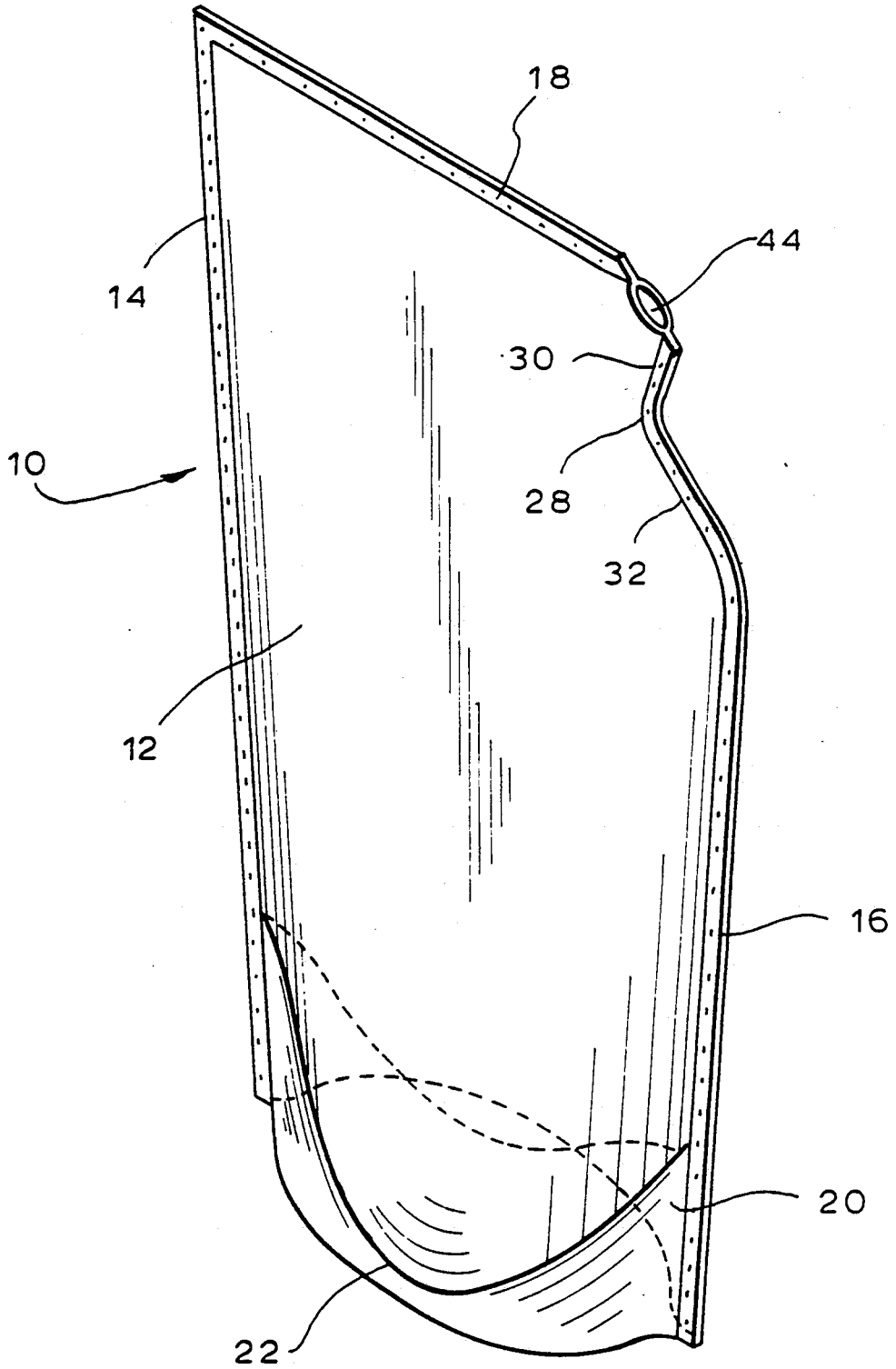
FIG. 3 is a perspective view of the flexible pouch of FIG. 1 with the spout open.

In accordance with the first preferred embodiment of the invention depicted in FIGS. 1–3, pouch 10 is constructed from two sheets 12 of flexible wall material which are sealed together along their peripheral edges to form a closed inner chamber for holding liquid. The wall material is preferably transparent or translucent plastic of a type which will not react with the ingredients in the liquid to be stored in the pouch chamber.

During manufacture, two sheets 12 of wall material having the same shape are arranged against each other with their peripheries mutually overlapping. The corresponding peripheral edges 14, 16, 18 and 20 are bonded by heat sealing, sonic welding, adhesive or like means to form a closed inner chamber of the pouch. The bottom edge 20 is gusseted along contour 22 to enable the pouch to stand upright when filled with liquid.

Alternatively the chamber could be formed from a single sheet of wall material by folding the wall material and then bonding the overlapping portions of the periphery of the single sheet.

After the first bonding operation, a recess 24 is formed in the respective sheets of wall material by cutting along side peripheral edge 16. This recess has a maximum height which is greater than the maximum depth measured in a direction transverse to the direction along which the height is measured. Further, in accordance with the first preferred embodiment of the invention, the recess begins at the top of the pouch. After recess 24 is formed, the respective sheets of wall material are bonded along the rim of the recess to again close off the pouch chamber.

In accordance with the first preferred embodiment of the invention, the bonded edge of the recess has a generally inwardly curved portion 28 with generally straight portions 30 and 32 extending therefrom.

Recess 24 defines a closed pouring spout 34. As can be seen in FIG. 1, the closed spout 34 can be rounded to improve the strength and appearance of the spout.

The contour depicted in FIG. 1 maximizes the storage capacity of the pouch, enhances the structural strength at the pouring spout and permits refilling of containers having necks of different diameters.

FIG. 2 depicts the refilling of a container 40 by inserting the open spout of pouch 10 in open neck 42. Spout 34 is opened by cutting along line A—A (see FIG. 1). Cut A—A should be made at an angle of 30 to 60 degrees with respect to the top peripheral edge 18, preferably 45 degrees. A 45-degree cut permits the liquid contents of the pouch to be readily drained through spout opening 44 and into neck 42 of container 40.

In accordance with the first preferred embodiment, generally straight portions 30 and 32 lie at an angle of between 25 and 30 degrees relative to the side peripheral edge 16. However, portions 30 and 32 can lie at an angle of less than 25 degrees relative to the side peripheral edge 16. However, as the angle of portion 30 relative to edge 16 is decreased, the angle between portion 30 and top edge 18 is correspondingly increased. In turn, a wider angle between portion 30 and top edge 18 means that spout opening 44 can be inserted into neck 42 of container 40 to a corresponding lesser depth. Since spout 34 is flexible, the greater the depth of insertion of spout opening 44 into neck 42, the lesser the risk that spout opening 44 will fall out of neck 42 in the event that pouch 10 is jostled during refilling of container 40. Thus a smaller angle between portion 30 and edge 18 will reduce the risk of spillage for a given neck diameter of the container being refilled.

Figure 4:
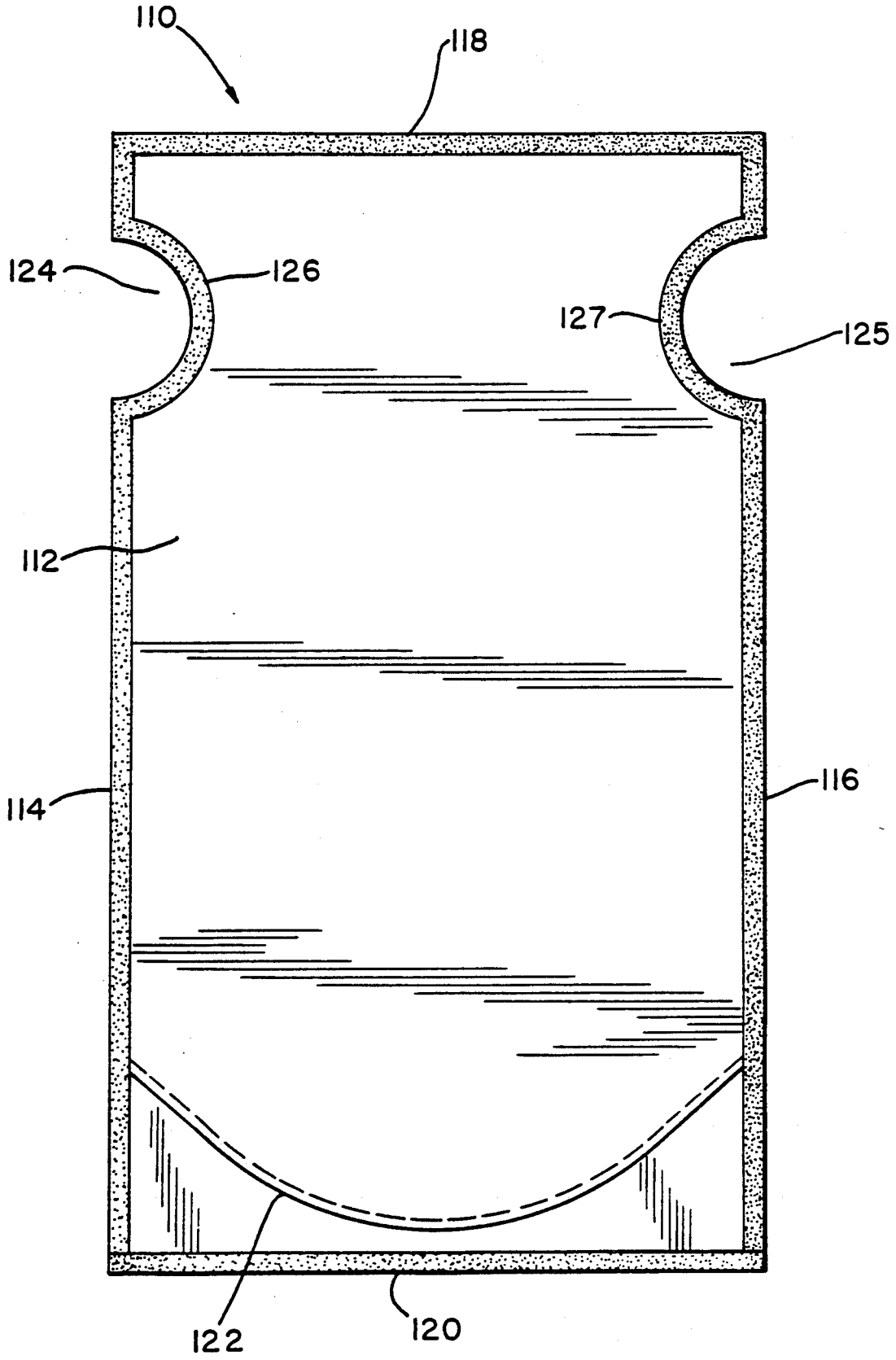
FIG. 4 is a side view of a flexible pouch with closed pouring spout in accordance with a second preferred embodiment of the invention.
Figure 5:
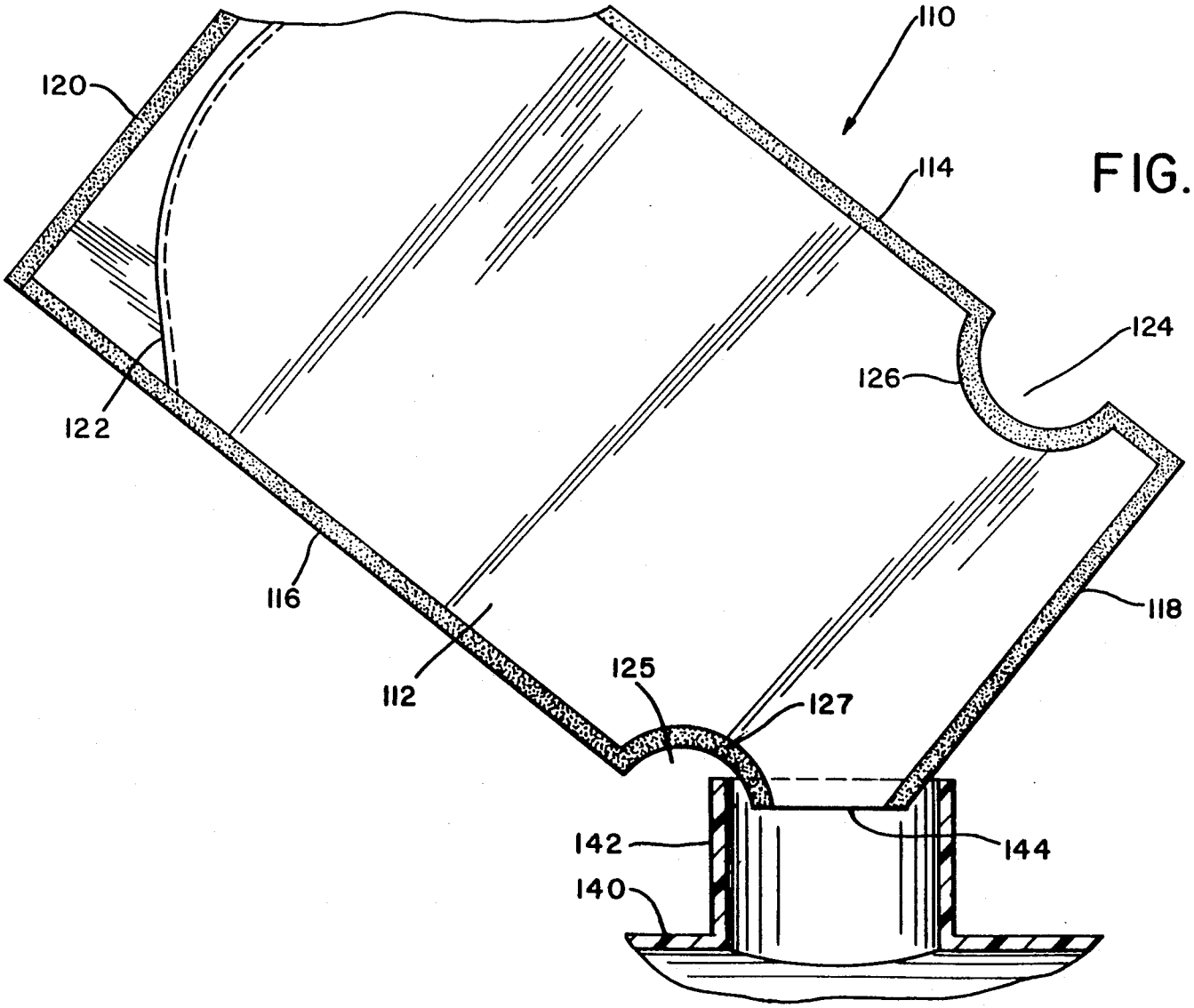
FIG. 5 is a partial side view of the flexible pouch of FIG. 4 with the spout open and a partial sectional view of the neck of a container to be filled in which the open spout has been inserted.
Figure 6:
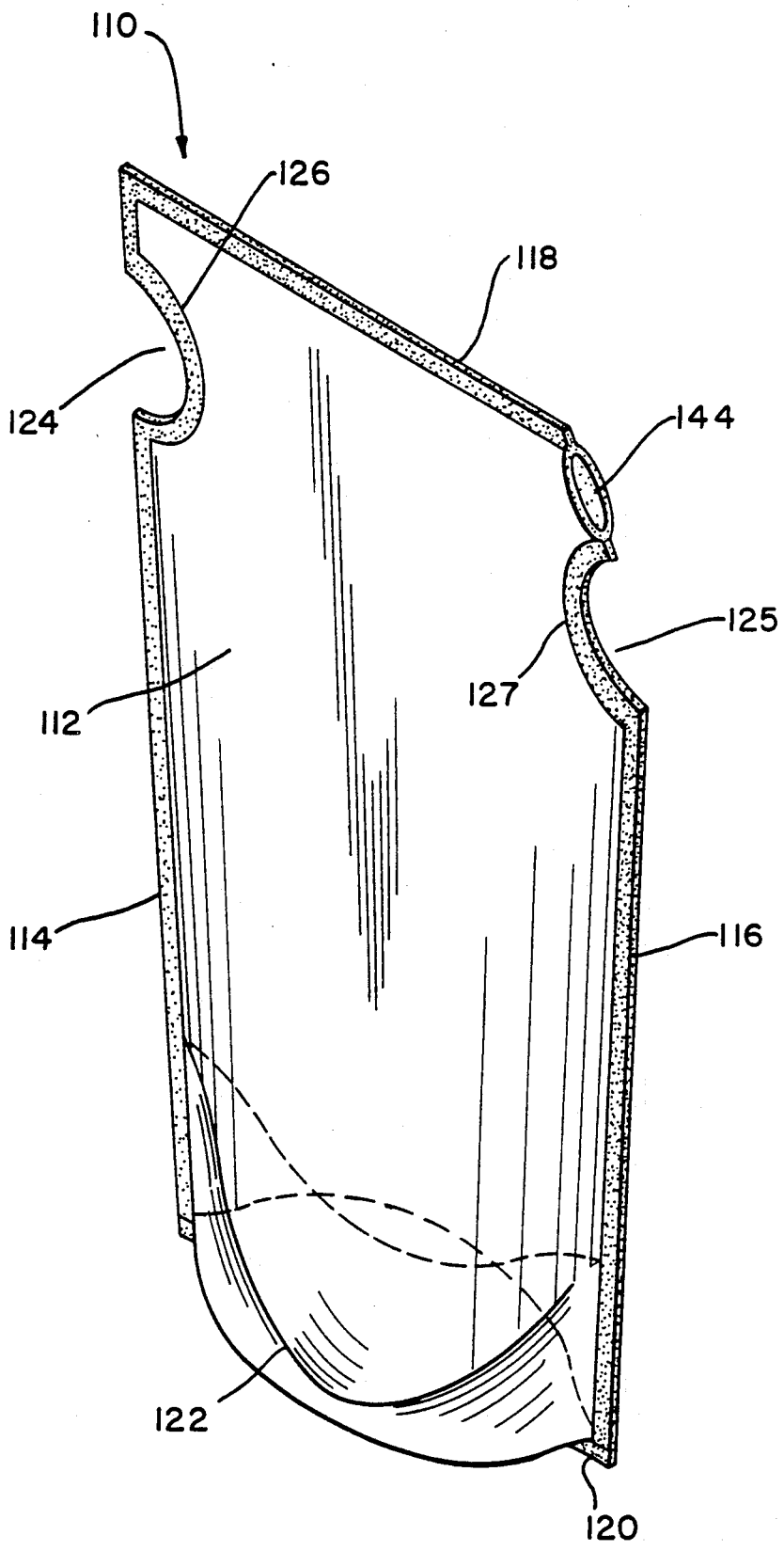
FIG. 6 is a perspective view of the flexible pouch of FIG. 4 with the spout open.

In accordance with the second preferred embodiment of the invention depicted in FIGS. 4–6, pouch 110 is constructed from two sheets 112 of flexible wall material which are bonded together along their peripheral edges to form a closed inner chamber for holding liquid. The wall material is preferably transparent or translucent plastic of a type which will not react with the ingredients in the liquid to be stored in the pouch chamber.

During manufacture, two sheets 112 of wall material having the same shape are arranged against each other with their peripheries mutually overlapping. The corresponding peripheral edges 114, 116, 118 and 120 are bonded by heat sealing, sonic welding, adhesive or like means to form a closed inner chamber of the pouch. The bottom edge 120 is gusseted along contour 122 to enable the pouch to stand upright when filled with liquid.

Alternatively the chamber could be formed from a single sheet of wall material by folding the wall material and then bonding the overlapping portions of the periphery of the single sheet.

After the first bonding operation, recesses 124 and 125 are formed in the respective sheets of wall material by cutting along side peripheral edges 112 and 116 respectively. Each recess has a maximum height which is greater than the maximum depth measured in a direction transverse to the direction along which the height is measured. Further, in accordance with the second preferred embodiment of the invention, each recess begins at a point spaced from the top peripheral edge 118 of the pouch. After recesses 124 and 125 are formed, the respective sheets of wall material are bonded along the edges 126 and 127 respectively of the recesses to again close off the pouch chamber.

In accordance with the second preferred embodiment of the invention, the bonded edges 126, 127 of the recesses 124, 125 have a generally semicircular shape. Recesses 124 and 125 respectively define closed pouring spouts 134 and 135.

FIG. 5 depicts the refilling of a container 140 by inserting the open spout of pouch 110 in open neck 142. Spout 34 is opened by cutting along line B—B (see FIG. 4). Cut B—B should be made at an angle of 30 to 60 degrees with respect to the top peripheral edge 118, preferably 45 degrees, and should be placed so that top peripheral edge 118 and the rim 127 of recess 125 are both cut. A 45-degree cut permits the liquid contents of the pouch to be readily drained through spout opening 144 and into neck 142 of container 140.

In accordance with the second preferred embodiment, recess 125 is spaced relative to top peripheral edge 118 such that spout opening 144 has the desired dimension when cut B—B is made. This also applies to the spacing of recess 124 from top peripheral edge 118.

The provision of a second recess 124 is advantageous, but is not essential to the invention. However, because of the collapsible nature of a pouch made of flexible sheets of wall material, folds in the pouch can entrap some fluid so that the trapped fluid will not drain out open spout 144. In that event, spout 134 can be opened by cutting to provide an alternate path for drainage of the previously trapped fluid from pouch 110 into the container to be refilled.

The second recess can be formed simultaneously with formation of the first recess in the pouch. Moreover, if the pouches are formed in succession by bonding sheet material unrolled from continuous webs, the recesses in different pouches can be advantageously formed simultaneously.

Numerous modifications are possible in light of the above disclosure. For example, the preferred pouch 10 includes sheet walls 12 which are bonded together at their peripheral edges 14–20 to define an inner chamber. A bottom edge 20 is gusseted along contour 30 to provide a self-standing feature. Alternatively, the pouch could be formed from a single folded sheet bonded at its overlapping edges, and a contoured gusseted insert. Similarly, although the spout 34 is preferably opened by cut A—A at a 45-degree angle relative to the peripheral edge 18, this angular relation is not critical.

What is claimed is:

1. A flexible self-standing pouch for storing liquid therein, comprising first and second wall means made of nonrigid sheet material, said first wall means having a first peripheral edge and said second wall means having a second peripheral edge, said first peripheral edge being bonded to said second peripheral edge to form a sealed juncture, said first and second wall means and said sealed juncture defining a closed chamber, said juncture comprising a top portion connected to a first side portion and a second side portion, the top portion juncture being of a length less than the width of the pouch first and second wall means, said first portion in turn comprising an inwardly curved portion spaced from said top portion which defines a recess in said pouch, said recess having a maximum height which is greater than the maximum depth measured in a direction transverse to the direction along which the height is measured, whereby opposing portions of said first and second wall means forming a pouch portion suitable for use as a spout when said opposing portions of said wall means are cut along a line extending from a point along said recess to a point along said top portion.

2. The pouch as defined in claim 1, wherein said first and second wall means are not integrally connected and said juncture has a closed contour.

3. The pouch as defined in claim 1, wherein said juncture further comprises a second side portion connected to said top portion and a bottom portion connected to said first and second side portions.

4. The pouch as defined in claim 1, wherein said juncture comprises a heat sealing.

5. The pouch as defined in claim 1, wherein said juncture is formed with adhesive.

6. The pouch as defined in claim 1, wherein said juncture is formed by sonic welding.

7. The pouch as defined in claim 1, wherein said pouch is gusseted.

8. The pouch as defined in claim 1, wherein said first side portion further comprising first and second substantially straight portions connected to said inwardly curved portion, said first substantially straight portion being arranged adjacent to an end of said top portion.

9. The pouch as defined in claim 8, wherein said top portion is substantially straight, said top portion and said first substantially straight portion forming an angle therebetween which is less than 90 degrees.

10. The pouch as defined in claim 1, wherein said nonrigid sheet material comprises plastic.

* * * * *